United States Patent [19]

Fiorucci

[11] Patent Number: 4,693,195

[45] Date of Patent: Sep. 15, 1987

[54] SEWING SEAM, PARTICULARLY FOR JEAN FABRIC

[75] Inventor: Elio Fiorucci, Milan, Italy

[73] Assignee: Fiorucci S.p.A., San Donato Milanese, Italy

[21] Appl. No.: 871,020

[22] Filed: Jun. 3, 1986

[30] Foreign Application Priority Data

Mar. 6, 1986 [IT] Italy ..... 21145/86[U]

[51] Int. Cl.[4] ..... D05B 97/00; B32B 7/08; A41D 27/24

[52] U.S. Cl. ..... 112/262.1; 112/441; 2/275

[58] Field of Search ..... 112/262.1, 440, 441, 112/402; 2/275

[56] References Cited

U.S. PATENT DOCUMENTS

| | | | |
|---|---|---|---|
| 229,760 | 7/1880 | Schroeder | 112/262.1 X |
| 1,199,782 | 10/1916 | Gruman | 112/262.1 X |
| 1,977,802 | 10/1934 | Miskend | 2/275 X |
| 2,095,886 | 10/1937 | Neuman | 2/275 X |
| 2,720,655 | 10/1955 | Simon et al. | 2/275 X |

*Primary Examiner*—H. Hampton Hunter

*Attorney, Agent, or Firm*—Guido Modiano; Albert Josif

[57] ABSTRACT

This seam, particularly for jean and denim fabric, comprises a string element defining stitches formed by a saddlery sewing machine and joining together fabric flaps to be interconnected.

4 Claims, 3 Drawing Figures

SEWING SEAM, PARTICULARLY FOR JEAN FABRIC

BACKGROUND OF THE INVENTION

This invention relates to a sewing seam, particularly for jean fabric.

As is known, in the sewing of seams during the manufacture of such jean or denim clothing apparel as trousers, skirts, jackets, and the like, the fabric edges or flaps to be joined are sewn together using two types of seams which respectively imply the execution of two different sewing methods. A first type of seam is obtained by a sewing method which consists of interlockingly doubling the free edges of the fabric over each other, thus pairing them together to define a seam, then, sewing along the seam using a twin needle sewing machine which produces, from a standard thin yarn, two spaced apart and substantially parallel extending seams with stitches having a relatively small pitch.

Another type of seam implies the execution of a sewing method which consists of pairing together the two fabric flaps as juxtaposed to each other with a first seam, obtained for example by blind stitching at a distance from the free edge of the fabric, followed by a second seam effective to join the free edges together, thereby one portion of each flap will be doubled under the fabric and then secured by sewing on it by means of a twin needle machine to produce a finished seam which is similar to the seam previously described.

The above described seam types, which are adopted universally, while affording generally satisfactory results, have shown to be unable to always provide the required strength of joint at the seam, especially in view of the fact that denim or jean clothing apparel is traditionally intended for "heavy-duty" applications, such as work clothes or sport clothes.

Furthermore, known types of seams for jean fabric which imply the use of a sewing machine which forms relatively closely pitched stitches, may result in some cases in the fabric being weakened by the large number of perforations unavoidably made by the sewing needles.

SUMMARY OF THE INVENTION

It is the aim of this invention to eliminate such prior disadvantages by providing a seam particularly for jean or denim fabric which affords the obtainment of a joint between two fabric edges or flaps which has enhanced strength characteristics.

Within the above aim, it is a particular object of this invention to provide a seam which allows the use of much longer pitch stitches than those which are used in the making of traditional types of seams, which, as stated hereinabove, compulsorily imply the use of closely pitched stitches, thereby causing a large number of perforations to be formed in the fabric, causing weakening of the fabric along the seam.

Another object of this invention is to provide a seam which, additionally to having improved mechanical characteristics, affords a novel aesthetic effect for the clothing apparel by providing a raised seam which constitutes a feature of the finished apparel.

A not least object of this invention is to provide a seam particularly for denim or jean fabric which can be readily formed on commercially available equipment, and which is of simple construction.

The above aim, and these and other objects to become apparent hereinafter, are achieved by a seam particularly for jean and denim fabric, according to the invention, characterized in that it comprises a cord-like element defining stitches adapted for joining together fabric flaps to be interconnected.

BRIEF DESCRIPTION OF THE DRAWINGS

Further features and advantages will be apparent from the following detailed description of a seam particularly for jean fabric, shown by way of illustration and not of limitation in the accompanying drawings, wherein.

DESCRIPTION OF THE PREFERRED EMBODIMENTS

Figure 1:
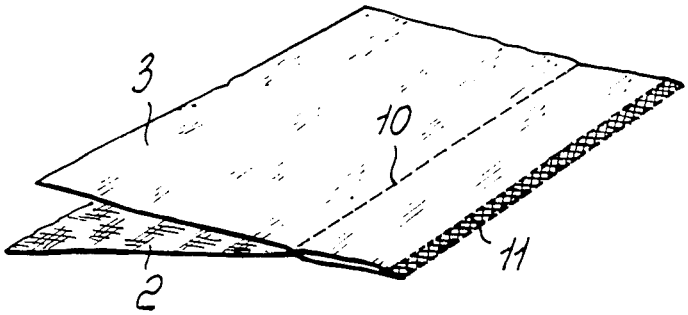
FIG. 1 shows two fabric pieces as initially sewn together by a basting line and hemming seam.

With reference to the cited drawing figures, the seam, according to the invention, particularly intended for use in the manufacture of denim fabric clothing apparel comprises a cord-like element, generally designated with the reference numeral 1, which is used to form stitches having a long pitch of preferably 6 to 10 mm in length. In practice, such stitching of the cord-like element may be effected by using a sewing machine of the type which is generally used in the saddlery industry for sewing materials such as leather and the like.

In actual practice, in order to make a seam according to the invention, the fabric pieces to be joined, as indicated schematically at 2 and 3, would be first paired together by overlapping and joining them by sewing along a seam or basting line 10 spaced inwardly from the edges of the pieces of fabric, and a hemming seam 11 which extends parallel to the basting line 10 and which joins together the free edges of the pieces of fabric 2, 3.

The flap provided between the seam or basting line 10 and the hemming seam strip is then doubled over substantially at the basting line 10 to define, at the unexposed or inside face of the fabric a fold line 20, which is then sewn by means of the cord-like element 1 which securely joins the fabric pieces 2 and 3 together, concurrently with the flap which is delimited by the seam or basting line 10 and hemming seam 11.

Figure 2:
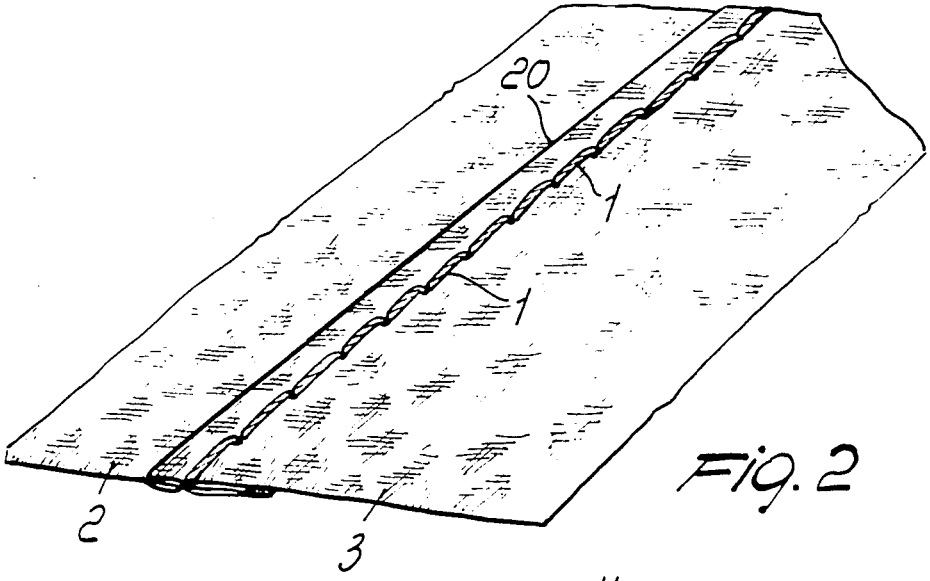
FIG. 2 is a perspective view showing a completed portion of the seam according to the present invention, as viewed from the exposed or outside surface.
Figure 3:
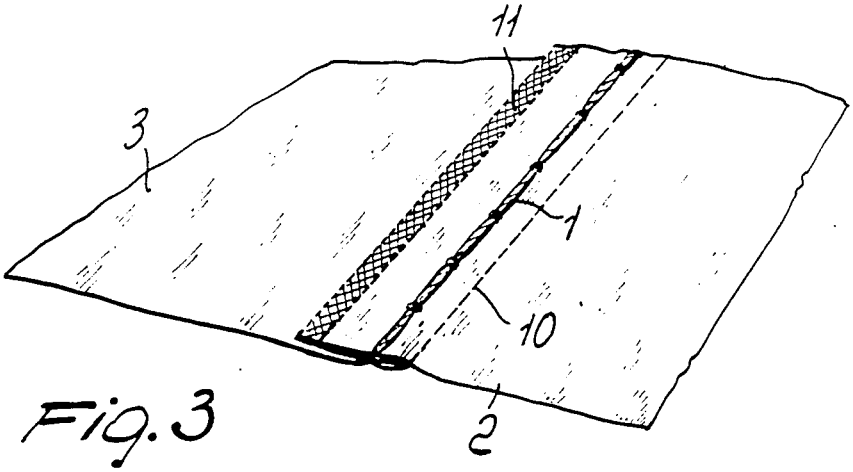
FIG. 3 shows a portion of a completed seam according to the invention, as viewed from the unexposed or inside surface.

The seam 1, on the exposed or outside face, is thus arranged so that the fold line 20 defined on the outside face of the fabric overlies the seam or basting line 10, which is thus hidden from view. As illustrated in FIG. 2, the cord element is used to form stitches having a long pitch, requiring a reduced number of perforations to be made in the fabric thus providing a mechanically strong joint or seam. On the outside or exposed face of the fabric, the cord-like element constitutes a decorative element defined by the stitches having a long pitch and extending linearly, and parallel to the fold line 20 (see FIG. 2), while on the inside or unexposed face, the stitches formed by the cord-like element 1 extended parallel to the hemming seam 11 (see FIG. 3).

It may be appreciated from the foregoing description that the invention achieves its objects, and in particular the fact is emphasized that a seam is provided which is mechanically effective, because it permits the use of a cord-like element to realize a very firm and durable seam by virtue of the fact that it is much stronger than standard sewing thread, and also due to the fact that because of its higher strength, longer pitch stitches can be used which in turn require the fabric to be perforated far fewer times than when seams are conventionally sewn using ordinary thread, thus retaining as much of the original strength of the fabric as possible where it is most needed in practice i.e.: at the joint.

Furthermore, the seam according to the invention has the advantage of creating a desirable aesthetic design which, in practice, constitutes a feature of the finished apparel by creating a seam comprising stitches made with a cord-like element, which, by having a thickness dimension which is much greater than ordinary sewing thread, protrudes from the surface of the fabric.

In practicing the invention, any materials dimensions and contingent shapes, may be used according to requirements.

I claim:

1. A sewing seam particularly for jean fabric having in combination therewith at least one fabric flap having an edge, an edge portion and an overlapped portion and at least one other fabric flap having an other edge and an other edge portion, said sewing seam comprising at least one hemming seam, at least one fold, at least one basting line, and stitches including a plurality of perforations, and at least one cord-like element, said hemming seam being substantially rigidly associated with said edge of said one fabric flap and with said other edge of said other fabric flap, said basting line being substantially rigidly associated with said one fabric flap and said other fabric flap and extending substantially parallel to said hemming seam, between said hemming seam and said basting line there being defined a doubled flap edge portion, said doubled flap edge portion comprising said edge portion of said one fabric flap and said other edge portion of said other fabric flap, said at least one fold being formed substantially at said basting line and causing said doubled flap edge portion to overlie said at least one fabric flap at said overlapped portion thereof, said perforations being formed in said doubled flap edge portion and said overlapped portion of said at least one fabric flap, said cord-like element successively extending through said perforations and thus defining said stitches, said stitches being adapted for joining together said doubled flap edge portion and said overlapped portion of said at least one fabric flap.

2. A sewing seam according to claim 1 wherein said stitches define a pitch length dimension, said pitch length dimension being defined by at least one portion of said cord-like element, said at least one portion of said cord-like element extending substantially linearly between one of said perforations in said plurality of perforations and a successive one other of said perforations in said plurality of perforations, between said one of said perforations and said successive one other of said perforations there being defined a distance, said distance corresponding to said pitch length dimension of said stitches and being comprised within the range of 6 to 10 mm.

3. A sewing seam according to claim 1, wherein said at least one fabric flap has a first flap face, wherein said at least one other fabric flap has an other flap face, and wherein said cord-like element has a thickness dimension, said stitches protruding outwardly from said first flap face of said at least one fabric flap and from said other flap face of said at least one other fabric flap for a distance corresponding to said thickness dimension of said cord-like element.

4. A sewing seam according to claim 1, wherein said stitches join together said overlapped portion of said at least one fabric flap and said doubled flap edge portion, said overlapped portion of said at least one fabric flap comprising an area, said area being laterally delimited by said basting line and said hemming line.

* * * * *